US009766028B2

(12) United States Patent
Pagnoncelli et al.

(10) Patent No.: US 9,766,028 B2
(45) Date of Patent: Sep. 19, 2017

(54) CYLINDER IMPELLER FOR REVOLVING GUNS AND REVOLVER

(71) Applicant: Forjas Taurus S.A., Sao Leopoldo, RS (BR)

(72) Inventors: Jamir Pagnoncelli, Canoas (BR); Juliano Batista Bisotto, Cachoeirinha (BR); André Machado De Magalhães, Gravatai (BR)

(73) Assignee: Forjas Taurus S.A., Sao Leopoldo, RS (BR)

( * ) Notice: Subject to any disclaimer, the term of this patent is extended or adjusted under 35 U.S.C. 154(b) by 0 days.

(21) Appl. No.: 15/078,207

(22) Filed: Mar. 23, 2016

(65) Prior Publication Data

US 2017/0241725 A1 Aug. 24, 2017

(30) Foreign Application Priority Data

Feb. 24, 2016 (BR) ..... 10 2016 003967-3

(51) Int. Cl.
*F41A 9/27* (2006.01)
*F41C 3/14* (2006.01)
*F41A 19/52* (2006.01)

(52) U.S. Cl.
CPC ..... *F41A 9/27* (2013.01); *F41A 19/52* (2013.01); *F41C 3/14* (2013.01)

(58) Field of Classification Search
CPC .... F41A 9/27; F41A 19/52–19/53; F41C 3/14
See application file for complete search history.

(56) References Cited

U.S. PATENT DOCUMENTS 3,701,213 A * 10/1972 Lewis ..... F41C 3/14 42/65
4,102,241 A * 7/1978 Magardo ..... F41A 9/27 89/155
4,218,839 A * 8/1980 Brouthers ..... F41C 3/14 42/65
4,397,110 A * 8/1983 Landry ..... F41C 3/14 42/65
2015/0338177 A1* 11/2015 Assis ..... F41C 3/14 42/62

* cited by examiner

*Primary Examiner* — Stephen M Johnson
*Assistant Examiner* — Joshua Semick
(74) *Attorney, Agent, or Firm* — The Webb Law Firm

(57) ABSTRACT

A cylinder impeller for revolvers, which transmits the trigger pulling movement to a cylinder revolving movement. The impeller includes a cover having inside it a track; a one-piece body having a plate and a slider, said slider being able to slide within and relative to the cover; and a spring arranged between the body slider and the surface of the cover track. Therefore, the cover and the body slide one relative to the other and against the spring action, thus varying the overall length of the impeller and compensating and absorbing possible teeth machining variations of the cylinder extractor.

6 Claims, 3 Drawing Sheets

CYLINDER IMPELLER FOR REVOLVING GUNS AND REVOLVER

CROSS-REFERENCE TO RELATED APPLICATION

This application claims priority to Brazilian Patent Application No. 10 2016 003967-3 filed Feb. 24, 2016, the disclosure of which is hereby incorporated in its entirety by reference.

BACKGROUND OF THE INVENTION

Field of the Invention

The present invention relates to an impeller for a revolver cylinder and, more particularly, to a cylinder impeller comprising two parts that moves therebetween.

Description of Related Art

Revolvers are defined as revolving cylinder firearms containing multiple chambers where ammunition cartridges are housed. When a shot is fired the cylinder revolves to an angle corresponding to the distance between two consecutive chambers in order to align a new chamber (with new ammunition cartridge) to the gun's barrel.

The configuration adopted by revolver manufacturers, especially double-action revolvers, comprises of a cylinder impeller pulled by the gun's trigger. In particular, and as shown in FIG. 1, said impeller 101 has basically the shape of a fixed length rigid rod and comprises articulation and actuation means at each one of its ends. Specifically in the bottom end, this cylinder impeller is hinged, by means of a pin 102, to the trigger 103. The cylinder impeller upper end acts on the named extractor teeth 104, equal in number to the number of the cylinder chambers 106, disposed on the top of the extractor, integral part of the cylinder set 105. The cylinder impeller actuation on these teeth 104, each time the trigger is pulled, changes the cylinder angular position and positions a new chamber relative to the barrel.

The cylinder impeller functions are basically two:

- To lead (by revolving) the cylinder to the new position, ensuring that a new chamber, previously loaded with ammunition, is aligned to the gun's barrel; and
- to lock in keyway the cylinder in the new position, i.e. to keep it aligned with the gun's barrel and without side movements at the time the gun is fired.

Although this operation mechanism has been used for long time, it is not free from drawbacks. To properly secure the above mentioned performances, the cylinder impeller must act likewise on each extractor teeth. The number of these teeth can reach ten depending on the revolver model.

It is the first drawback of the current system to ensure that each tooth is in the same position at the time of positioning and keying the cylinder. To achieve this, it is necessary to work with very strict machining tolerances, increasing the cost of the process, or to set up, for said teeth, manual adjustment levels. This manual adjustment, which must be properly done in each one of the teeth, also makes more expensive the process, besides causing, with some frequency, exceeding adjustment problems. The removal of material more than what is necessary disables the extractor, since it creates air-gaps in the system.

SUMMARY OF THE INVENTION

Therefore, it is a first object of the present invention an impeller designed to revolve, put in position and keyed the cylinder before each shot, said impeller being able to compensate for any air-gaps or dimensional inaccuracies in the cylinder extractor teeth.

It is a further object of the present invention a revolver provided with a cylinder impeller, which, by pulling the trigger, is able to revolve, to put in position and to lock in a key way the cylinder before each shot, compensating for any air-gaps or dimensional inaccuracies in the revolver firing mechanism.

These and other objects are achieved from a revolver provided with a cylinder impeller, designed to cause, from a trigger pulling movement, a cylinder revolving, said impeller comprising: a cover provided, on its upper portion, with a protrusion acting on the cylinder teeth and defining inside it a track; a one-piece body comprising a plate and a slider, said plate receiving the impeller pivoting pin in the trigger and said slider being able to slide within and in relation to the cover; and a spring disposed between the upper end of the body slider and the surface defining the upper limit of the cover track.

Furthermore, said impeller cover is provided, on its lower end, with an oblong opening and the body slider has a hole capable of receiving the pin, said pin limiting the body's course towards the cover by mechanical interference against the oblong borders.

In other words, to overcome the mentioned drawbacks it is proposed a cylinder impeller capable of absorbing the dimensional variations between the multiple extractor teeth. Therefore, the present invention comprises a non-rigid cylinder impeller which has two parts engaged each other and biased by a spring. One of these parts, named body, it is jointed to the trigger by means of a pin and the other part, named cover, acts on the extractor teeth. The second part, the cover, is movable relative to the body and contains the driving end. The two parts and the spring, which acts between them, form a not-rigid cylinder impeller, i.e. that it can vary along its overall length.

BRIEF DESCRIPTION OF THE DRAWINGS

The present invention will be better understood hereinafter from the following detailed description of a preferred embodiment of the invention, which is illustrated, by way of an indicative but not limitative example, in the accompanying drawings, where.

DESCRIPTION OF THE INVENTION

Figure 1:
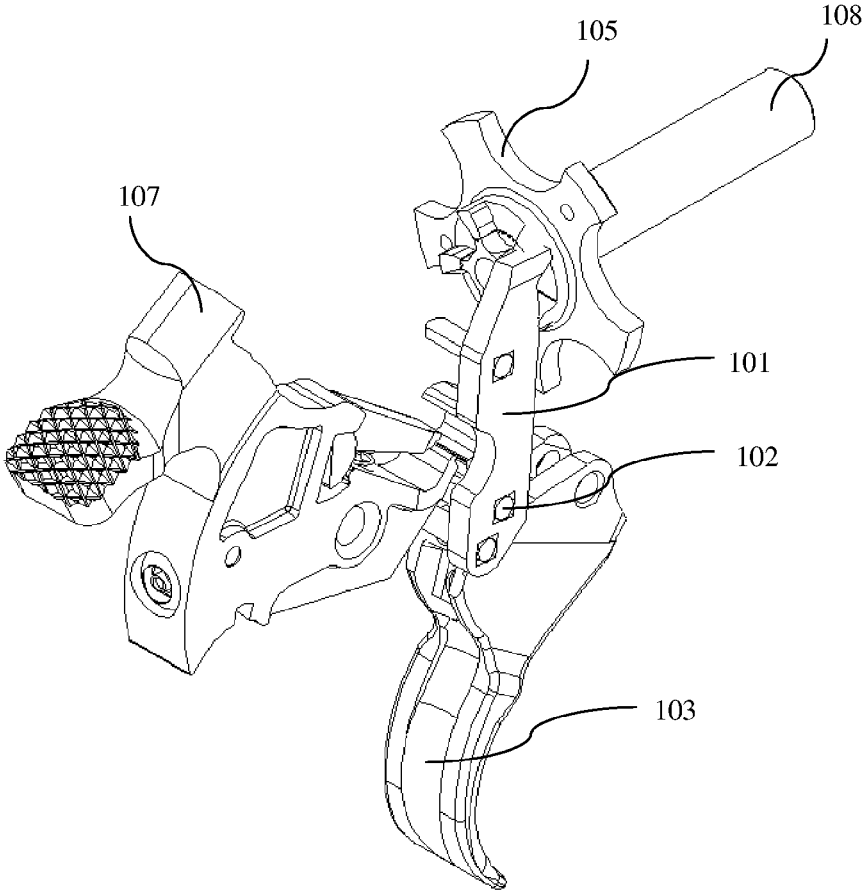
Fig 1 (Background Art)
FIG. 1 is a partially perspective view of a gun shooting mechanism according to the prior art.
Figure 2:
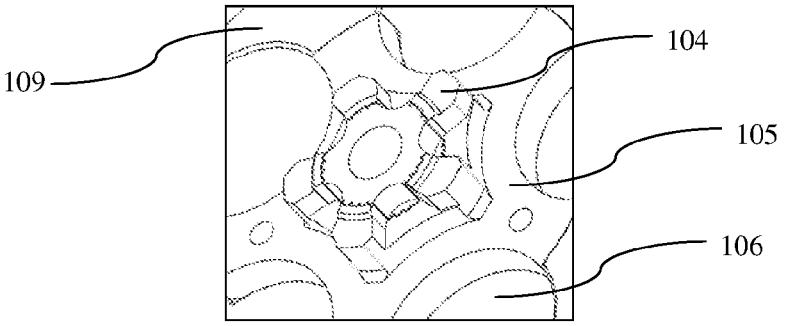
Fig 2 (Background Art)
FIG. 2 is a partially perspective view of the extractor teeth disposed on the front portion of the cylinder according to the prior art.
Figure 3:
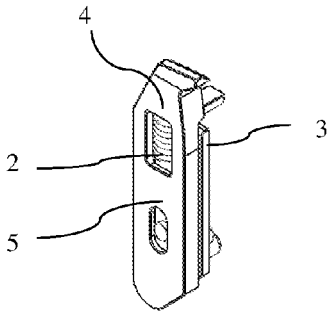
FIG. 3 is a perspective view of an impeller according to the present invention.
Figure 4:
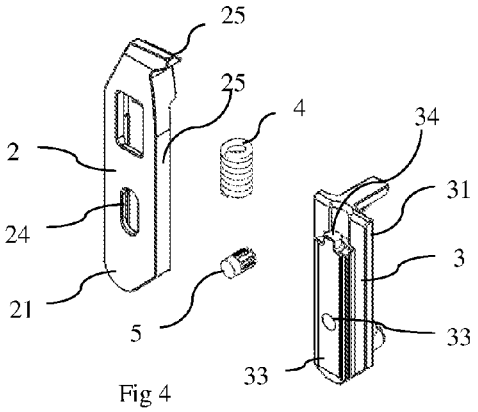
FIG. 4 is an exploded perspective view of the impeller of FIG. 3.
Figure 5:
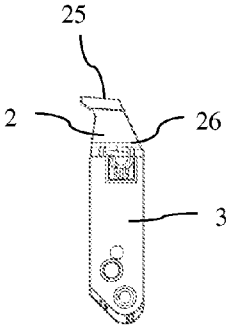
FIG. 5 is a rear view of the impeller of FIG. 3.
Figure 6:
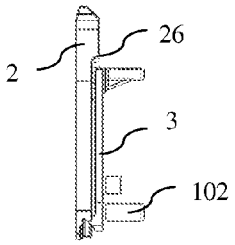
FIG. 6 is a side view of the impeller of FIG. 3.
Figure 7:
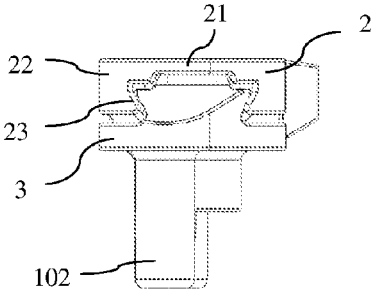
FIG. 7 is a top view of the impeller of FIG. 3.

As known, a revolver (see FIGS. 1 and 2) is a device used to fire the existing ammunition in the chamber 106 of the cylinder 105 from a stroke applied by the hammer 107, caused by the user action of pulling the trigger 103. Therefore, a revolver basically comprises a frame (not shown) of rectangular shape which covers the cylinder 105, allowing it to move by revolving around the cylinder's axis (not shown), which penetrates and remains in the central cylinder's 105 hole 108. In the front portion of the frame is fixed the barrel (not shown), while from the rear frame portion protrudes the butt (not shown). Inside the butt is disposed the hammer spring (not shown) which drive the hammer, whereas the grip is arranged around the butt (not shown).

Finally, in the lower portion of the frame is fixed, in a hinged manner, the trigger 103. Said trigger, when pulled by the user, moves the cylinder impeller, causing the cylinder's revolving as well as retreating the hammer against the hammer spring action.

FIGS. 3-7 illustrate a cylinder impeller 1 in accordance with the present invention. As herein mentioned the impeller 1 comprises a cover 2 and a body 3 so as the cover 2 allows the body 3 to slide in relation to the cover and said sliding is limited by the pin 5 and opposed by the spring 4. Therefore, and from the relative motion or sliding between the cover 2 and the body 3, it is possible to change the overall length of the impeller 1, thus compensating possible dimensional variations in the cylinder 105 teeth 104.

More specifically, said cover 2 has the shape of a plate 21 having on its side an edge 22. The inside portion of said edge 22 defines a cross-section track 23 preferably triangular (see FIG. 7). In the cover 2 lower portion there are an oblong opening 24, which acts as the pin 5 pathway. Finally, said cover 2 further has a protrusion 25, similar to those of the state of art impellers, which acts in relation to the cylinder 105 teeth 104.

On the other hand, the body 3 is a one-piece structure comprising a plate 31 opposed to a slider 32. In particular, said slider 32 has size and side edges allowing it to slide inside the cover 2, in particular along the track 23. In addition, the slider 32 further has a hole 33, facing the inner surface of the cover 2 and able to receive the pin 5. Therefore, when pin 5 is inserted into the hole 33, the oblong opening 24 limits the travel of the body 3 relative to cover 2.

Furthermore, the body 3 plate 31 has, in its lower portion, a seat (not shown) for receiving the impeller hinging pin 102 of the invention impeller with the trigger 103 of the firing mechanism of the revolver of the invention.

Finally, and as an important feature of the impeller of the invention, the upper portion of the body 3 slider 32 has a protrusion 34 to receive and center the lower end of the spring 4. Preferably, said spring 4 is a coil spring. The upper end of said spring 4 is opposed by a surface 26 which defines the upper limit of the cover 2 track 23. As a result of the position of the spring 4, between the cover 2 and the body 3, said cover and body assume, at rest, a maximum detachment position between the cover 2 protrusion 25 and the hinging pin 102 of the impeller in relation to the trigger 103. In other words, the impeller of the invention, at rest, assumes its longest possible length setting, this length being limited by the pin 5 path inside the oblong opening 24.

Figure 8:
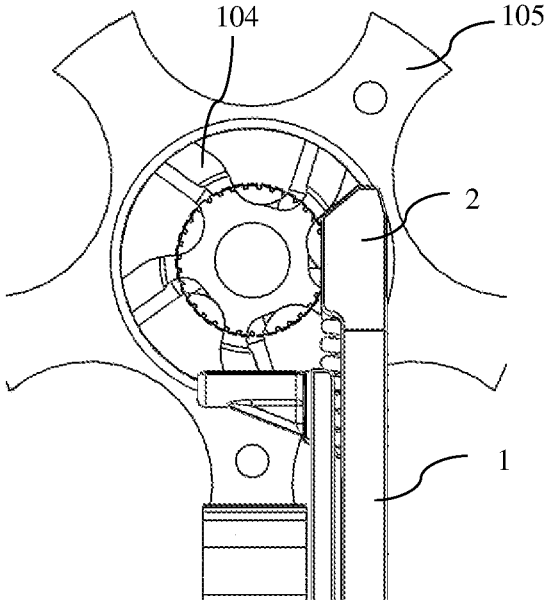
FIG. 8 is a partially elevation view of a revolver mechanism according to the present invention.

In operation, the impeller 1, according to the present invention acts like a conventional cylinder impeller (see FIG. 8). When it is actuated by the trigger 103 (impeller moved up), its upper end acts on an extractor tooth 104, causing the cylinder 105 revolving and positioning the corresponding chamber aligning it with the revolver barrel. At the end of the upward impeller course, with the cylinder already positioned, the cylinder impeller mobile cover 2 presses the tooth 104 against which it is acting thanks to the spring 4 which acts between the body 3 and the cover 2 of the cylinder 1. Therefore, there is no need for keying it. Additionally, in the proposed embodiment, the cylinder impeller 1 according to the invention absorbs any variations in the extractor teeth 104 machining, due to the automatic adjustment of the spring 4 and therefore the cover 2.

The invention claimed is:

1. A cylinder impeller for revolvers, which transmits a trigger pulling movement on a cylinder revolving movement, said impeller comprising:

a cover provided with a protrusion on an upper portion thereof acting on cylinder teeth, and the cover defining a track;

a one-piece body comprising a plate and a slider, said plate receiving an impeller pivoting pin on a trigger, and said slider being able to slide within and in relation to the cover; and a spring disposed between a slider upper end of the one-piece body and a surface defining a slider upper limit of the cover, wherein said cover comprises, at a lower end of the cover, an oblong opening, and the slider of the one-piece body comprises a hole configured to receive a pin, said pin limiting travel of the one-piece body relative to the cover by mechanical interference against the oblong opening.

2. The impeller according to claim 1, wherein the slider upper end comprises a protrusion which receives and centers a spring lower end.

3. The impeller according to claim 1, wherein said cover comprises a plate shape comprising on a side portion of the plate shape an edge, and wherein an inside of said edge defines a cross-section track, wherein the cross-section track is triangular.

4. A revolver comprising an impeller which transmits a trigger pulling movement on a cylinder revolving movement, said impeller comprising:

a cover provided, in an upper portion, with a protrusion acting on cylinder teeth, and the cover defining a track;

a one-piece body comprising a plate and a slider, said plate receiving an impeller pivoting pin on a trigger, and said slider being able to slide within and in relation to the cover; and a spring disposed between a slider upper end of the one-piece body and a surface defining a slider upper limit of the cover, wherein said cover comprises, at a lower end of the cover, an oblong opening, and the slider of the one-piece body comprises a hole configured to receive a pin, said pin limiting travel of the one-piece body relative to the cover by mechanical interference against the oblong opening.

5. The revolver according to claim 4, wherein the slider upper end comprises a protrusion which receives and centers a spring lower end.

6. The revolver according to claim 4, wherein said cover comprises a plate shape comprising on a side portion of the plate shape an edge, and wherein an inside of said edge defines a cross-section track, wherein the cross-section track is triangular.

* * * * *